US010695939B2

(12) United States Patent
Fuchs et al.

(10) Patent No.: US 10,695,939 B2
(45) Date of Patent: Jun. 30, 2020

(54) POWER TOOL SEPARATION DEVICE

(71) Applicant: Robert Bosch GmbH, Stuttgart (DE)

(72) Inventors: Rudolf Fuchs, Neuhausen (DE); Petr Grulich, Kirchheim/Teck (DE); Uwe Engelfried, Ostfildern (DE)

(73) Assignee: Robert Bosch GmbH, Stuttgart (DE)

( * ) Notice: Subject to any disclaimer, the term of this patent is extended or adjusted under 35 U.S.C. 154(b) by 27 days.

(21) Appl. No.: 15/994,280

(22) Filed: May 31, 2018

(65) Prior Publication Data

US 2018/0272556 A1 Sep. 27, 2018

Related U.S. Application Data

(62) Division of application No. 14/001,585, filed as application No. PCT/EP2012/000939 on Mar. 2, 2012, now Pat. No. 10,052,785.

(30) Foreign Application Priority Data

Mar. 3, 2011 (DE) ..... 10 2011 005 011

(51) Int. Cl.
*B27B 33/14* (2006.01)
*B27B 17/02* (2006.01)

(52) U.S. Cl.
CPC ..... *B27B 33/148* (2013.01); *B27B 17/02* (2013.01); *B27B 33/14* (2013.01); *B27B 33/147* (2013.01); *Y10T 83/913* (2015.04)

(58) Field of Classification Search
CPC ..... B27B 33/148; B27B 33/144
See application file for complete search history.

(56) References Cited

U.S. PATENT DOCUMENTS

| | | | |
|---|---|---|---|
| 1,260,702 | A | 3/1918 | Olson |
| 1,634,643 | A | 7/1927 | Bens |
| 2,032,609 | A | 3/1936 | Arsneau |
| 2,308,847 | A | 1/1943 | Wolf |
| 2,348,612 | A | 5/1944 | Deacon |
| 2,649,871 | A | 8/1953 | Desbarat |
| 2,774,395 | A | 12/1956 | Tweedie |
| 2,924,110 | A | 2/1960 | Gudmundsen |

(Continued)

FOREIGN PATENT DOCUMENTS

| | | |
|---|---|---|
| CH | 221 661 | 6/1942 |
| CN | 85 1 01913 A | 1/1987 |

(Continued)

OTHER PUBLICATIONS

International Search Report corresponding to PCT Application No. PCT/EP2012/000939, dated Aug. 6, 2012 (German and English language document) (7 pages).

*Primary Examiner* — Andrea L Wellington
*Assistant Examiner* — Fernando A Ayala
(74) *Attorney, Agent, or Firm* — Maginot, Moore & Beck LLP

(57) ABSTRACT

The disclosure relates to a power tool separation device, in particular a hand-held power tool separation device, comprising at least one cutting unit which comprises at least two interconnected cutter support elements. At least two cutter support elements are interconnected by means of at least one connecting element of the cutting unit, and the connecting element is essentially flush with at least one outer surface of the at least two cutter support elements.

10 Claims, 7 Drawing Sheets

(56) References Cited

U.S. PATENT DOCUMENTS

| | | | | |
|---|---|---|---|---|
| 2,992,660 | A | 7/1961 | Merz | |
| 3,040,789 | A | 6/1962 | Mall et al. | |
| 3,224,476 | A | 12/1965 | Chadwich | |
| 3,444,907 | A | 5/1969 | Chadwick | |
| 3,478,787 | A | 11/1969 | Miller | |
| 3,537,347 | A | 11/1970 | Rogers | |
| 3,605,123 | A * | 9/1971 | Hahn | A61F 2/30767 623/23.55 |
| 3,910,147 | A | 10/1975 | Heyerdahl | |
| 4,018,660 | A | 4/1977 | Hansen et al. | |
| 4,038,463 | A | 7/1977 | Lamarine et al. | |
| 4,615,171 | A * | 10/1986 | Burk | F16G 13/06 29/898.1 |
| 5,226,404 | A | 7/1993 | Mogi et al. | |
| 5,413,158 | A | 5/1995 | Wirth, Jr. et al. | |
| 6,021,826 | A | 2/2000 | Daniell | |
| 10,052,785 | B2 * | 8/2018 | Fuchs | B27B 17/02 |
| 2003/0051351 | A1 | 3/2003 | Buchholtz et al. | |
| 2011/0100188 | A1 | 5/2011 | Goettel et al. | |
| 2012/0005901 | A1 | 1/2012 | Gerstenberger et al. | |
| 2017/0266007 | A1 * | 9/2017 | Gelaude | A61F 2/30749 |

FOREIGN PATENT DOCUMENTS

| | | | |
|---|---|---|---|
| DE | 2 358 559 | | 5/1974 |
| EP | 0 423 501 | A2 | 4/1991 |
| SU | 284274 | | 4/1971 |
| SU | 1493835 | A1 | 7/1989 |
| WO | 2012116834 | | 9/2012 |

* cited by examiner

POWER TOOL SEPARATION DEVICE

CLAIM OF PRIORITY

This application is a divisional of co-pending U.S. patent application Ser. No. 14/001,585, filed on Oct. 30, 2013, the entire disclosure of which is incorporated herein by reference, and which is a 35 U.S.C. § 371 National Stage Application of PCT/EP2012/000939, filed on Mar. 2, 2012, which claims the benefit of priority to Serial No. DE 10 2011 005 011.6, filed on Mar. 3, 2011 in Germany, the disclosures of which are incorporated herein by reference in their entirety.

BACKGROUND

Power tool separation devices, in particular hand-held power tool separation devices, that have a cutting assembly which comprises at least two interconnected cutter support elements are already known.

SUMMARY

The disclosure relates to a power tool separation device, in particular a hand-held power tool separation device, having at least one cutting assembly which comprises at least two interconnected cutter support elements.

It is proposed for the at least two cutter support elements to be interconnected by means of at least one connecting element of the cutting assembly, said connecting element terminating at least substantially flush with at least one outer face of one of the at least two cutter support elements. Here, a "cutting assembly" is to be understood in particular to mean a unit that is provided to locally cancel an atomic bond of a workpiece to be machined, in particular by means of a mechanical detachment and/or by means of a mechanical removal of material particles of the workpiece. The cutting assembly is preferably provided to separate the workpiece into at least two parts physically separated from one another and/or to detach and/or to remove, at least in part, material particles of the workpiece starting from a surface of the workpiece. The cutting assembly is particularly preferably moved in a circulating manner in at least one operating state, in particular along a peripheral direction of a guide unit of the power tool separation device. Here, a "cutter support element" is to be understood in particular to mean an element, on which at least one cutting element for detaching and/or for removing material particles of a workpiece to be machined is arranged. The term "connecting element" is intended here in particular to define an element that is provided to interconnect at least two component parts in a form-locked and/or force-locked manner, in particular to interconnect said component parts movably so as to transmit a driving force and/or a driving torque. In this context, the term "provided" is to be understood in particular to mean specifically designed and/or specifically equipped. Here, the expression "terminate at least substantially flush" is to be understood in particular to mean an arrangement of the connecting element in an assembled state, wherein the connecting element, in the case of a connecting element formed separately from the cutter support elements, considered along a longitudinal axis of the connecting element, and in the case of a connecting element formed in one piece with one of the cutter support elements, considered along a transverse axis of the connecting element, extends within the at least one connecting recess receiving the connecting element and extends at most as far as an outer surface of the cutter support element which comprises the connecting recess. The connecting element in an assembled state, in particular in the case of a connecting element formed separately from the cutter support elements, particularly preferably extends at most from an outer face of one of the cutter support elements to a further outer face of one of the cutter support elements. By means of the embodiment according to the disclosure, a compact power tool separation device can be achieved advantageously.

Furthermore, it is proposed for the connecting element to be formed at least partly in one piece with at least one of the at least two cutter support elements. Here, the term "in one piece" is to be understood in particular to mean connected at least in a force-locked manner, for example by means of a welding process, an adhesive bonding process, an injection process and/or another process appearing sensible to a person skilled in the art, and/or is advantageously to be understood to mean formed in one piece, for example by means of production from a cast part and/or by means of production in a conventional or multi-component injection molding method and advantageously from an individual blank. The cutter support elements particularly preferably each have a connecting element and a connecting recess for receiving a connecting element of a further cutter support element connectable to the respective cutter support element. In an alternative embodiment of the power tool separation device according to the disclosure, the connecting element is formed as a component formed separately from the cutter support elements. In this case, the cutter support elements preferably each have two connecting recesses, into each of which a connecting element can be inserted. By means of the one-piece embodiment of the connecting element, an assembly effort can advantageously be kept low.

The connecting element is preferably formed as a longitudinal extension of at least one of the at least two cutter support elements. Each cutter support element of the cutting assembly particularly preferably has at least one connecting element formed as a longitudinal extension and one connecting recess corresponding to the connecting element. Here, a "longitudinal extension" is to be understood in particular to mean an element that is formed in one piece with the cutter support element and that extends at least substantially along a longitudinal extension of the cutter support element and that is provided, in a state connected to a further cutter support element, to provide a connection, in particular a form-locked connection. In this case, a movable connection, in particular a pivotable connection, of the cutter support elements relative to one another is provided by means of a cooperation between the longitudinal extension of the cutter support element and the connecting recess, formed in a manner corresponding to the longitudinal extension, in the further cutter support element. The longitudinal extension of the cutter support element preferably runs at least substantially parallel to a primary direction of movement of the cutter support element, along which the cutter support element is moved in order to make a cut, etc. by means of a cutting element arranged on the cutter support element. Here, the expression "substantially parallel" is to be understood in particular to mean an orientation of a direction relative to a reference direction, in particular in a plane, wherein the direction has a deviation with respect to the reference direction in particular of less than 8°, advantageously less than 5°, and particularly advantageously less than 2°. An easily assembled connection between the cutter support elements can advantageously be provided by means of the embodiment according to the disclosure.

The longitudinal extension is advantageously hook-shaped. Here, "hook-shaped" is to be understood in particular to mean a geometric embodiment of the longitudinal extension which, considered along the longitudinal extension of the cutter support element, enables an edge region of the connecting recess to be engaged from behind by means of the longitudinal extension in an interconnected state of the cutter support elements. In this case, the longitudinal extension, considered in the cutting plane of the cutting assembly, is formed in particular in a manner deviating from a rod-shaped extension, on which a circular form-locking element is formed and/or in particular in a manner deviating from a semi-circular shape. A transmission of driving forces, in particular tractive forces, can be enabled with a simple construction.

Furthermore, it is proposed in an alternative embodiment of the power tool separation device, for the connecting element to be formed as a pin. The pin is preferably cylindrical. The pin is particularly preferably formed so as to be rotationally symmetrical about at least one axis. In this case, the connecting element formed as a pin can be formed in one piece with or separately from the cutter support element. It is also conceivable however for the connecting element to have a different embodiment appearing sensible to a person skilled in the art. A connecting element can be achieved with a simple construction.

In addition, it is proposed for at least one of the at least two cutter support elements to have at least one transverse securing element, which is provided to at least largely prevent a transverse movement of the cutter support elements relative to one another in a coupled state of the cutter support elements. Each cutter support element of the power tool separation device preferably comprises at least two transverse securing elements. In this case, the at least two transverse securing elements are provided to at least largely prevent a relative transverse movement of the interconnected cutter support elements in two oppositely directed directions. One of the at least two transverse securing elements is thus preferably provided to at least largely prevent a transverse movement running along one of the oppositely directed directions. The at least two transverse securing elements are preferably arranged on the cutter support element so as to be offset, in particular angularly offset, relative to one another. The expression "to at least largely prevent a transverse movement of the cutter support elements relative to one another in a coupled state" is to define here in particular a delimitation of a movement relative to one another of the cutter support elements, connected to one another by means of connecting elements, by means of the transverse securing element along a movement path running at least substantially perpendicular to a longitudinal axis of the cutter support elements. The movement path of the cutter support elements relative to one another is delimited in this case in particular by means of the transverse securing element to a value less than 5 mm, preferably less than 2 mm and particularly preferably less than 1 mm. The transverse securing element is preferably provided to at least largely avoid or to delimit a transverse movement by means of a form-locked connection. It is also conceivable however for the transverse securing element to be provided to at least largely avoid or to delimit a transverse movement by means of another method appearing sensible to a person skilled in the art, for example by means of a force-locked connection. By means of the embodiment according to the disclosure, a lateral offset of the cutter support elements relative to one another can advantageously be at least largely prevented during operation, in particular as a cut is made, etc. A precise result can thus be achieved advantageously.

The transverse securing element is particularly preferably formed integrally on the at least one of the at least two cutter support elements by means of a stamping method. It is also conceivable however for the transverse securing element to be arranged on the cutter support element by means of another method appearing sensible to a person skilled in the art, for example by means of a casting method, by means of an adhesive bonding method, by means of a soldering method, by means of a milling method, etc. By means of a forming of the transverse securing element by a stamping method, the transverse securing element can be formed subsequent to manufacture of the cutter support element. The transverse securing element can additionally be formed advantageously in a cost-effective manner.

Furthermore, it is proposed for at least one of the at least two cutter support elements to have at least one segment guide element, which is provided to delimit a movement of the at least one of the at least two cutter support elements, in a state arranged in a guide unit, considered in a direction remote from the guide unit, at least along a direction running at least substantially parallel to a cutting plane of the cutting assembly. Each cutter support element of the cutting assembly of the power tool separation device particularly preferably has at least one segment guide element, which is provided to delimit a movement of the at least one of the at least two cutter support elements, in a state arranged in a guide unit, considered in a direction remote from the guide unit, at least along a direction running at least substantially parallel to a cutting plane of the cutting assembly. The power tool separation device preferably has a least one guide unit for receiving the cutting assembly, said guide unit comprising at least one segment counter guide element corresponding to the segment guide element. Guidance along a direction of the cutting assembly running at least substantially parallel to a cutting plane of the cutting assembly can thus be achieved with a simple construction.

The power tool separation device advantageously has at least one guide unit for receiving the cutting assembly, the connecting element being guided at least in part in said guide unit. Here, a "guide unit" is to be understood in particular to mean a unit that is provided to exert on the cutting assembly a coercive force at least along a direction perpendicular to a cutting direction of the cutting assembly so as to predefine a possibility for movement of the cutting assembly along the cutting direction. The guide unit preferably has at least one guide element, in particular a guide groove, by means of which the cutting assembly is guided. The cutting assembly, considered in a cutting plane, is preferably guided along a total periphery of the guide unit by the guide unit by means of the guide element, in particular the guide groove. Here, the term "cutting plane" is to define in particular a plane in which the cutting assembly is moved relative to the guide unit in at least one operating state along a periphery of the guide unit in at least two oppositely directed cutting directions. The cutting plane, as a workpiece is machined, is preferably oriented at least substantially transverse to a workpiece surface to be machined. Here, the expression "at least substantially transverse" is to be understood in particular to mean an orientation of a plane and/or of a direction relative to a further plane and/or a further direction, which preferably deviates from a parallel orientation of the plane and/or the direction relative to the further plane and/or the further direction. It is also conceivable however for the cutting plane, as a workpiece is machined, to be aligned at least substantially parallel to a workpiece surface to be machined, in particular in the event that the cutting assembly is formed as a grinding means, etc. Here, the expression "at least substantially parallel" is to be understood in particular to mean an orientation of a direction relative to a reference direction, in particular in a plane, wherein the direction has a deviation with respect to the reference direction in particular of less than 8°, advantageously of less than 5°, and particularly advantageously of less than 2°.

Here, a "cutting direction" is to be understood in particular to mean a direction along which the cutting assembly is moved in order to generate a cutting gap and/or to detach and/or to remove material particles of a workpiece to be machined in at least one operating state as a result of a driving force and/or a driving torque, in particular in the guide unit. The cutting assembly is preferably moved in an operating state along the cutting direction relative to the guide unit. The cutting assembly and the guide unit preferably together form a closed system. The guide unit preferably has a geometric design that, considered in the cutting plane, has a closed outer contour comprising at least two straight lines running parallel to one another and at least two connecting portions, in particular circular arcs, interconnecting ends of the straight lines facing towards one another. Here, the term "closed system" is to define in particular a system that comprises at least two components which, by means of a cooperation, maintain a functionality in a state of the system disassembled from another system superordinate to the aforesaid system, such as a power tool, and/or which are inseparably interconnected in the disassembled state. The at least two components of the closed system are preferably interconnected in a manner that is at least substantially inseparable for a user. Here, the expression "at least substantially inseparable" is to be understood here in particular to mean a connection of at least two component parts that can only be separated from one another with the aid of separation tools, such as a saw, in particular a mechanical saw etc., and/or chemical separation means, such as solvents, etc. By means of the embodiment of the power tool separation device according to the disclosure, the cutting assembly can be guided with a simple construction.

In addition, it is proposed for the power tool separation device to comprise at least one torque transmission element mounted at least in part in the guide unit. The torque transmission element is preferably surrounded at least in part by side walls of the guide unit along at least one direction. The torque transmission element preferably has a concentric coupling recess, in which a pinion of a drive unit of a portable power tool and/or a gearwheel and/or a toothed shaft of a gear unit of the portable power tool can engage in an assembled state. In this case, the coupling recess is preferably formed by a hexagon socket. It is also conceivable however for the coupling recess to have another embodiment appearing sensible to a person skilled in the art. By the means of the embodiment of the power tool separation device according to the disclosure, a closed system that can be assembled comfortably by a user on a power tool provided for this purpose can be achieved with a simple construction. It is therefore advantageously possible to dispense with an individual assembly by the user of components, such as the cutting assembly, the guide unit and the torque transmission element, for use of the power tool separation device according to the disclosure.

At least one of the at least two cutter support elements, on a side of the cutter support element facing towards the torque transmission element, advantageously has at least one recess, in which the torque transmission element engages in at least one operating state for driving the cutting assembly. All cutter support elements of the cutting assembly, on the sides of the cutter support elements facing towards the torque transmission element, preferably have at least one recess, in which the torque transmission element engages in at least one operating state for driving the cutting assembly. Forces and/or torques for driving the cutting assembly can be transmitted to the cutter support element with a simple construction.

Furthermore, it is proposed for at least one of the at least two cutter support elements to be formed at least substantially in a circular-arc-shaped manner on a side of the cutter support element facing towards a torque transmission element mounted at least in part in the guide unit. The side of the at least one of the at least two cutter support elements facing towards the torque transmission element in an assembled state is formed in a circular-arc-shaped manner in particular in at least one sub-region, considered between a center axis of the connecting element arranged in and/or on the respective cutter support element and a center axis of a connecting recess of the respective cutter support element for receiving the connecting element. The circular-arc-shaped sub-region is preferably formed adjacently to the recess in which the torque transmission element engages. The circular-arc-shaped sub-region particularly preferably has a radius that corresponds at least substantially to a radius of a deflection contour of the guide unit, in particular of a deflection contour of a guide element of the guide unit arranged at a convex end. The side of the cutter support element facing towards the torque transmission element in an assembled state, in particular the sub-region, is preferably concave. A deflection of the cutter support element during operation of the power tool separation device can advantageously be achieved. A small deflection radius with a deflection of the cutter support element can also advantageously be provided.

The connecting element advantageously has a porous structure. Here, a "porous structure" is to be understood in particular to mean a structure that has a multiplicity of cavities, which are arranged within an overall volume of a body and/or of a material and thus influences a density of the body and/or of the material. The porous structure is preferably formed by pores of the connecting element that are arranged in the connecting element. In particular, the connecting element has a pore density that is greater than 10 ppi (pores per inch), preferably greater than 35 ppi and particularly preferably greater than 50 ppi. The connecting element particularly preferably has an open porosity. Here, an "open porosity" is to be understood in particular to mean a connection of the cavities and/or the pores to one another and a cooperation of the cavities and/or of the pores with the environment adjacent to the connecting element. By means of the porous structure, the connecting element can advantageously be saturated with lubricant, for example. A service life can thus advantageously be increased, and a maintenance intensity can advantageously be reduced.

Furthermore, the disclosure relates to a portable power tool comprising a coupling device for form-locked and/or force-locked coupling to a power tool separation device according to the disclosure. Here, a "portable power tool" is to be understood in particular to mean a power tool, in particular a hand-held power tool, which can be transported by an operator without the use of a transporting machine. The portable power tool in particular has a mass that is less than 40 kg, preferably less than 10 kg, and particularly preferably less than 5 kg. The power tool separation device according to the disclosure and the portable power tool according to the disclosure particularly preferably form a power tool system. A portable power tool that is particularly advantageously suitable for a broad spectrum of use can advantageously be achieved.

The power tool separation device according to the disclosure and/or the portable power tool according to the disclosure are not to be limited in this case to the above-described application and embodiment. In particular, the power tool separation device according to the disclosure and/or the portable power tool according to the disclosure can have a number of individual elements, components and units deviating from a number mentioned herein in order to fulfill a functionality described herein.

BRIEF DESCRIPTION OF THE DRAWINGS

Further advantages will emerge from the following description of the drawing. Exemplary embodiments of the disclosure are illustrated in the drawing. The drawing, the description and the claims contain numerous features in combination. A person skilled in the art will also expediently consider the features individually and combine them to form meaningful further combinations.

In the drawings.

DETAILED DESCRIPTION

Figure 1:
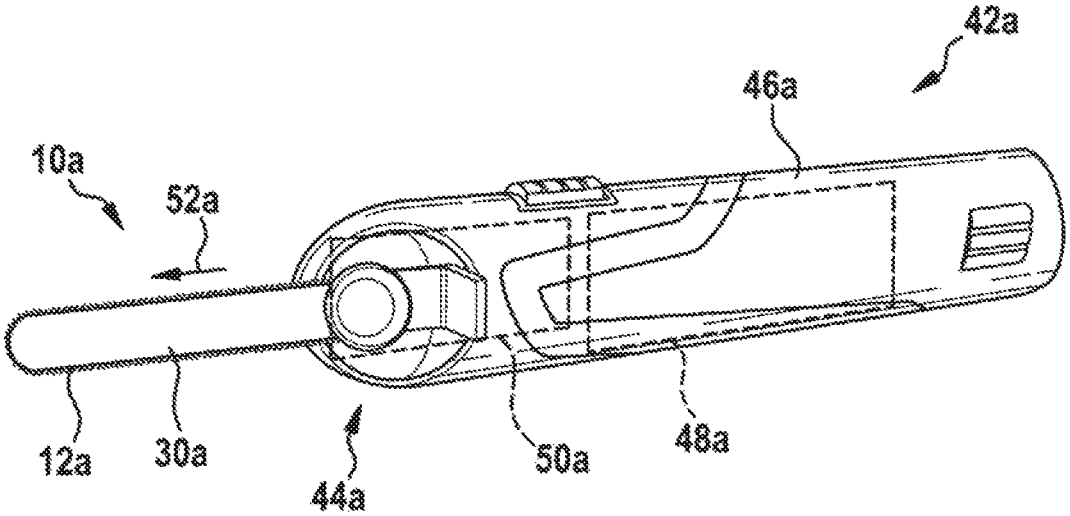
FIG. 1 shows a schematic illustration of a portable power tool according to the disclosure with a power tool separation device according to the disclosure.

FIG. 1 shows a portable power tool 42*a* with a power tool separation device 10*a*, which together form a power tool system. The portable power tool 42*a* has a coupling device 44*a* for form-locked and/or force-locked coupling to the power tool separation device 10*a*. The coupling device 44*a* can be formed in this case as a bayonet closure and/or as another coupling device appearing sensible to a person skilled in the art. Furthermore, the portable power tool 42*a* comprises a power tool housing 46*a*, which encloses a drive unit 48*a* and a gear unit 50*a* of the portable power tool 42*a*. The drive unit 48*a* and the gear unit 50*a* are functionally interconnected in a manner already known to a person skilled in the art for generation of a driving torque that can be transmitted to the power tool separation device 10*a*. The gear unit 50*a* is formed as a bevel gear. The drive unit 48*a* is formed as an electric motor unit. It is also conceivable however for the drive unit 48*a* and/or the gear unit 50*a* to have a different embodiment appearing sensible to a person skilled in the art. The drive unit 48*a* is provided to drive a cutting assembly 12*a* of the power tool separation device 10*a* in at least one operating state at a cutting rate less than 6 m/s. In this case, the portable power tool 42*a* has at least one operating mode, in which it is possible to drive the cutting assembly 12*a* in a guide unit 30*a* of the power tool separation device 10*a* along a cutting direction 52*a* of the cutting assembly 12*a* at a cutting rate less than 6 m/s.

Figure 2:
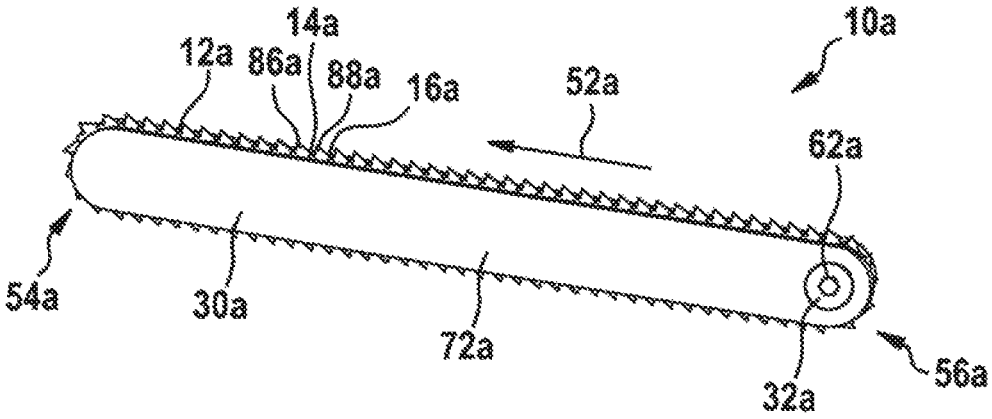
FIG. 2 shows a schematic illustration of a detail of the power tool separation device according to the disclosure.
Figure 5:
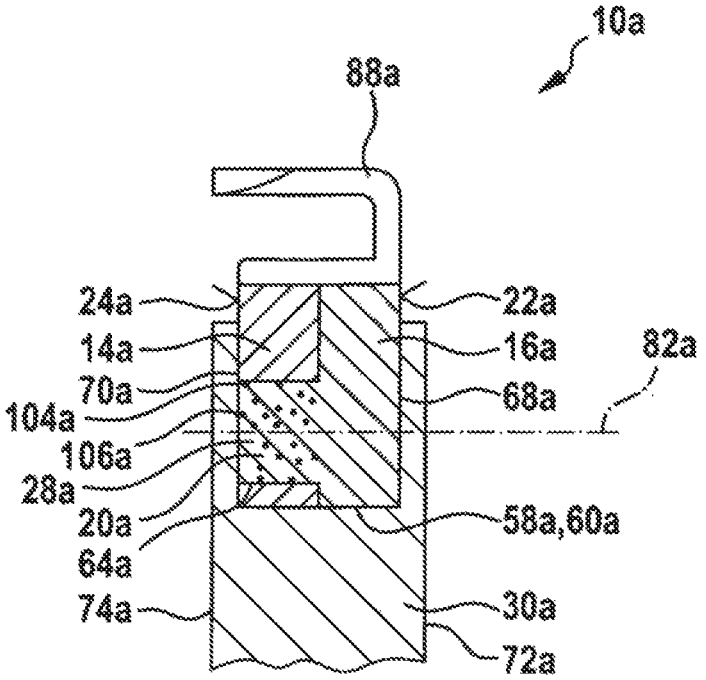
FIG. 5 shows a schematic illustration of a detail of an arrangement of the cutter support element in a guide unit of the power tool separation device according to the disclosure.

FIG. 2 shows the power tool separation device 10*a* in a state decoupled from the coupling device 44*a* of the portable power tool 42*a*. The power tool separation device 10*a* comprises the cutting assembly 12*a* and the guide unit 30*a*, which together form a closed system. The guide unit 30*a* is formed as a nose bar. Furthermore, the guide unit 30*a*, considered in a cutting plane of the cutting assembly 12*a*, has at least two convex ends 54*a*, 56*a*. The convex ends 54*a*, 56*a* of the guide unit 30*a* are arranged on two sides of the guide unit 30*a* remote from one another. The cutting assembly 12*a* is guided by means of the guide unit 30*a*. To this end, the guide unit 30*a* has at least one guide element 58*a* (FIG. 5), by means of which the cutting assembly 12*a* is guided. The guide element 58*a* is formed in this case as a guide groove 60*a*, which extends in a cutting plane of the cutting assembly 12*a* along a total periphery of the guide unit 30*a*. In this case, the cutting assembly 12*a* is guided by means of edge regions of the guide unit 30*a* delimiting the guide groove 60*a*. It is also conceivable however for the guide element 58*a* to be formed in another manner appearing sensible to a person skilled in the art, for example as a rib-like formation on the guide unit 30*a*, said formation engaging in a recess on the cutting assembly 12*a*. The cutting assembly 12*a*, considered in a plane running perpendicular to the cutting plane, is surrounded on three sides by the edge regions delimiting the guide groove 60*a* (FIG. 5). During operation, the cutting assembly 12*a* is moved relative to the guide unit 30*a* in a circulating manner along the periphery of the guide unit 30*a* in the guide groove 60*a*.

Furthermore, the power tool separation device 10*a* has a torque transmission element 32*a* mounted by means of the guide unit 30*a* for driving the cutting assembly 12*a*. The torque transmission element 32*a* is surrounded in an assembled state, considered in a plane running perpendicular to the cutting plane, by two outer walls 72*a*, 74*a* of the guide unit 30*a*. Furthermore, in a coupled state, the torque transmission element 32*a* is coupled to the drive of the cutting assembly 12*a* by means of a pinion (not illustrated here in greater detail) of the drive unit 48*a* and/or a gearwheel (not illustrated here in greater detail) and/or a toothed shaft (not illustrated here in greater detail) of the gear unit 50*a*. In this case, the torque transmission element 32*a* has a coupling recess 62*a*, which can be coupled in an assembled state to a drive element of the portable power tool 42*a*. The coupling recess 62*a* is arranged concentrically in the torque transmission element 32*a*. The coupling recess 62*a* is also provided so as to be coupled in a coupled state of the torque transmission element 32*a* and/or of the power tool separation device 10*a* to the pinion (not illustrated here in greater detail) of the drive unit 48*a* and/or the gearwheel (not illustrated here in greater detail) and/or the toothed shaft (not illustrated here in greater detail) of the gear unit 50*a*. The coupling recess 62*a* is formed as a hexagon socket. It is also conceivable however for the coupling recess 62*a* to have a different embodiment appearing sensible to a person skilled in the art.

Figure 3:
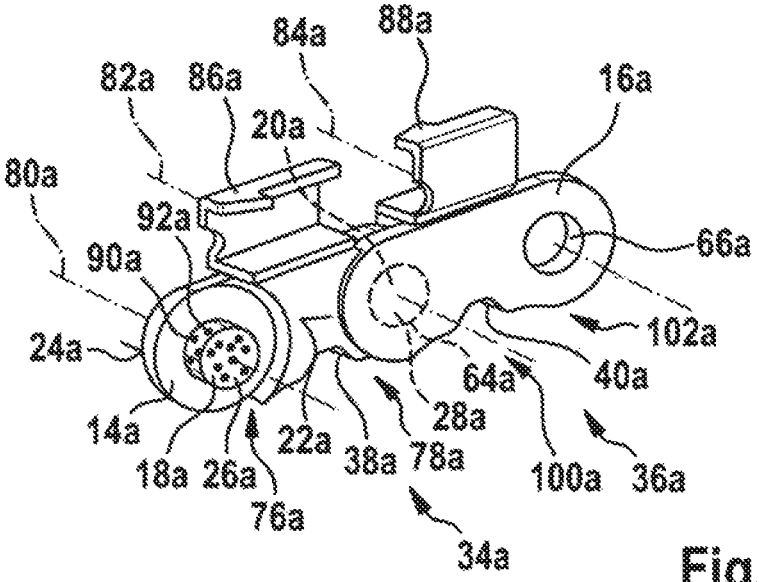
FIG. 3 shows a schematic illustration of a detail of cutter support elements of a cutting assembly of the power tool separation device according to the disclosure.

The cutting assembly 12*a* has a multiplicity of interconnected cutter support elements 14*a*, 16*a*, which are each interconnected by means of a connecting element 18*a*, 20*a* of the cutting assembly 12*a*, said connecting element terminating at least substantially flush with one of two outer faces 22*a*, 24*a* of one of the interconnected cutter support elements 14*a*, 16*a* (FIG. 3). The outer faces 22*a*, 24*a* run, in a state of the cutting assembly 12*a* arranged in the guide groove 60*a*, at least substantially parallel to the cutting plane. Depending on the application, a person skilled in the art will select a number of cutter support elements 14*a*, 16*a* suitable for the cutting assembly 12*a*. In FIG. 3, merely two interconnected cutter support elements 14*a*, 16*a* are illustrated, which are interconnected by means of one of the connecting elements 18*a*, 20*a*. The connecting elements 18*a*, 20*a* are formed as pins 26*a*, 28*a*. In this case, the connecting elements 18*a*, 20*a* are each formed in one piece with one of the cutter support elements 14*a*, 16*a*. The cutter support elements 14*a*, 16*a* each have a connecting recess 64*a*, 66*a* for receiving one of the connecting elements 18*a*, 20*a* of the interconnected cutter support elements 14*a*, 16*a*. The connecting elements 18*a*, 20*a* are guided by means of the guide unit 30*a* (FIG. 5). In this case, the connecting elements 18*a*, 20*a* are arranged in the guide groove 60*a* in an assembled state of the cutting assembly 12*a*. The connecting elements 18*a*, 20*a*, considered in a plane running perpendicular to the cutting plane, can be supported on two side walls 68*a*, 70*a* of the guide groove 60*a*. The side walls 68*a*, 70*a* of the guide groove 60*a*, considered in the cutting plane, extend outwardly starting from the guide unit 30*a*, perpendicular to the cutting device 52*a* of the cutting assembly 12*a*. The side walls 68*a*, 70*a* are also formed in one piece with the outer walls 72*a*, 74*a* of the guide unit 30*a*.

Furthermore, the connecting elements 18*a*, 20*a* have a porous structure. In this case, the connecting elements 18*a*, 20*a* each have a multiplicity of cavities 90*a*, 92*a*, 104*a*, 106*a*, which are arranged within total volumes of the connecting elements 18*a*, 20*a*. The cavities 90*a*, 92*a*, 104*a*, 106*a* are formed as pores. The cavities 90*a*, 92*a*, 104*a*, 106*a* can in this case be distributed uniformly and/or non-uniformly in the total volumes in the connecting elements 18*a*, 20*a*. The connecting elements 18*a*, 20*a* are each saturated with a lubricant (not illustrated here in greater detail), which is provided to lubricate a lubrication of the connecting elements 18*a*, 20*a* arranged movably in the connecting recesses 64*a*, 66*a* and in the guide groove 60*a*. The lubricant is in this case arranged in the cavities 90*a*, 92*a*, 104*a*, 106*a*, formed as pores, in the connecting elements 18*a*, 20*a*.

Figure 4:
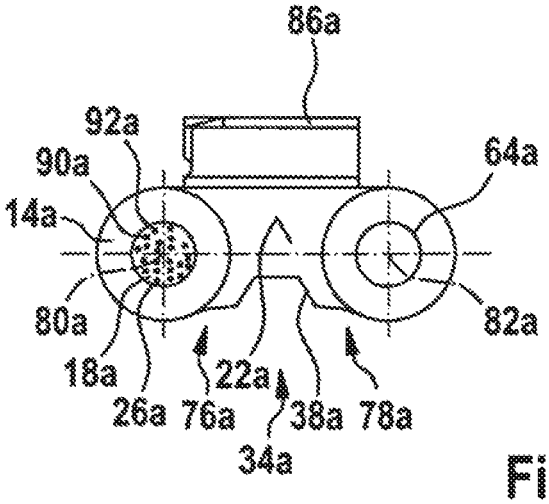
FIG. 4 shows a schematic illustration of a further detail of one of the cutter support elements of the cutting assembly of the power tool separation device according to the disclosure.

The cutter support elements 14*a*, 16*a* of the cutting assembly 12*a* further each have a recess 38*a*, 40*a*, which is arranged in each case in an assembled state on a side 34*a*, 36*a* of the respective cutter support element 14*a*, 16*a* facing towards the torque transmission element 32*a*. The torque transmission element 32*a* engages in the recesses 38*a*, 40*a* in at least one operating state for driving the cutting assembly 12*a*. The torque transmission element 32*a* is formed in this case as a gearwheel. The torque transmission element 32*a* thus comprises teeth (not illustrated here in greater detail), which are provided to engage in the recesses 38*a*, 40*a* of the cutter support elements 14*a*, 16*a* in at least one operating state for driving the cutting assembly 12*a*. Furthermore, the sides 34*a*, 36*a* of the cutter support elements 14*a*, 16*a* facing towards the torque transmission element 32*a* are formed in a circular-arc-shaped manner. The sides 34*a*, 36*a* of the cutter support elements 14*a*, 16*a* facing towards the torque transmission element 32*a* in an assembled state are each formed in a circular-arc-shaped manner in sub-regions 76*a*, 78*a*, 100*a*, 102*a*, considered between a center axis 80*a* of the respective connecting element 18*a*, 20*a* and a center axis 82*a*, 84*a* of the respective connecting recess 64*a*, 66*a*. The circular-arc-shaped sub-regions 76*a*, 78*a*, 100*a*, 102*a* are each formed adjacent to the recesses 38*a*, 40*a*, in which the torque transmission element 32*a* engages. In this case, the circular-arc-shaped sub-regions 76*a*, 78*a*, 100*a*, 102*a* have a radius that corresponds to a radius of a course of the guide groove 60*a* on the convex ends 54*a*, 56*a*. The sub-regions 76*a*, 78*a*, 100*a*, 102*a* are concave (FIGS. 3 and 4).

Furthermore, the cutting assembly 12*a* has cutting elements 86*a*, 88*a*. The cutting elements 86*a*, 88*a* are each formed in one piece with one of the cutter support elements 14*a*, 16*a*. A number of the cutting elements 86*a*, 88*a* is dependent on a number of cutter support elements 14*a*, 16*a*. A person skilled in the art will select a suitable number of cutting elements 86*a*, 88*a* depending on the number of cutter support elements 14*a*, 16*a*. The cutting elements 86*a*, 88*a* are provided to enable a detachment and/or a removal of material particles of a workpiece to be machined (not illustrated here in greater detail). The cutting elements 86*a*, 88*a* can be formed for example as full chisels, as semi-chisels, or other cutting types appearing sensible to a person skilled in the art that are provided to enable a detachment and/or a removal of material particles of a workpiece to be machined. The cutting assembly 12*a* is formed endlessly. The cutting assembly 12*a* is thus formed as a cutting chain. The cutter support elements 14*a*, 16*a* are formed in this case as chain links, which are interconnected by means of the pin-shaped connecting elements 18*a*, 20*a*. It is also conceivable however for the cutting assembly 12*a*, the cutter support elements 14*a*, 16*a* and/or the connecting elements 18*a*, 20*a* to be formed in another manner appearing sensible to a person skilled in the art.

Alternative exemplary embodiments are illustrated in FIGS. 6 to 16. Substantially unchanged components, features and functions are referenced in principle with the same reference signs. The letters a to d have been added to the reference signs in the exemplary embodiments in order to distinguish therebetween. The following description is limited substantially to the differences from the first exemplary embodiment in FIGS. 1 to 5, wherein reference can be made to the description of the first exemplary embodiment in FIGS. 1 to 5 with regard to unchanged components, features and functions.

Figure 6:
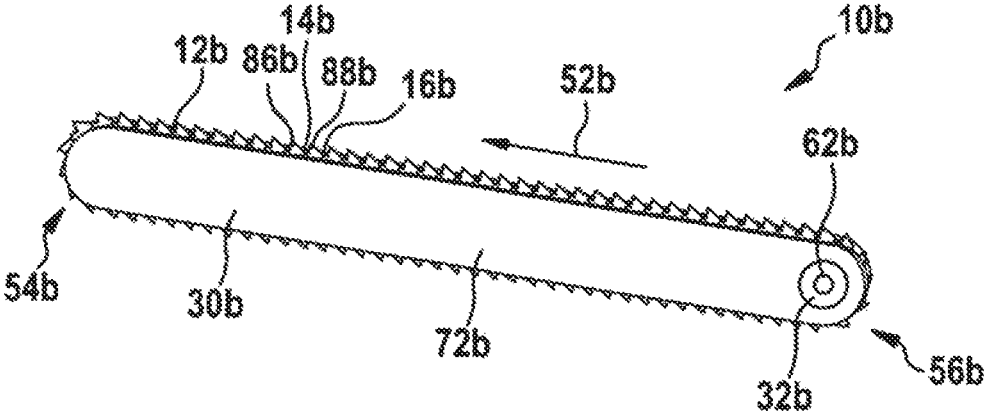
FIG. 6 shows a schematic illustration of a detail of an alternative power tool separation device according to the disclosure.
Figure 7:
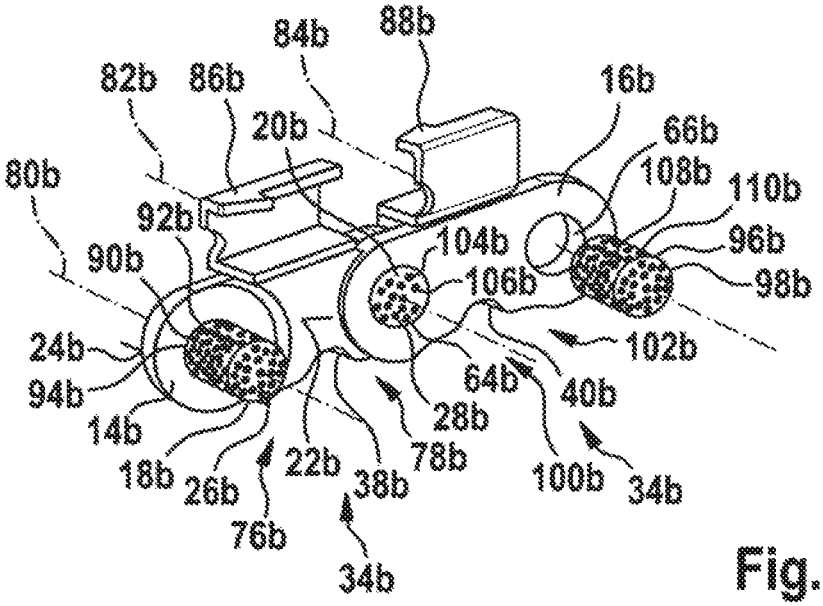
FIG. 7 shows a schematic illustration of a detail of cutter support elements of a cutting assembly of the alternative power tool separation device according to the disclosure.
Figure 8:
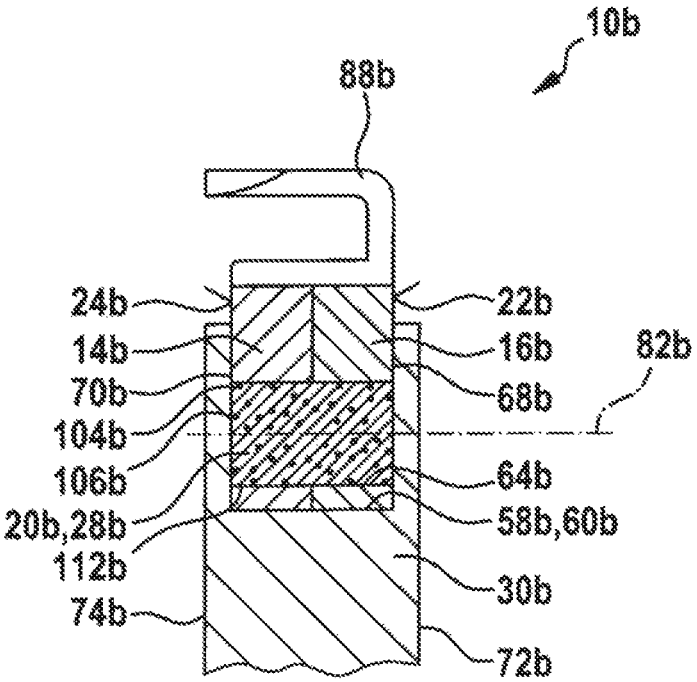
FIG. 8 shows a schematic illustration of a detail of an arrangement of the cutter support elements in a guide unit of the alternative power tool separation device according to the disclosure.

FIG. 6 shows an alternative power tool separation device 10*b*, which has a cutting assembly 12*b*, which comprises a multiplicity of interconnected cutter support elements 14*b*, 16*b*. The power tool separation device 10*b* can be functionally coupled to a coupling device (not illustrated here in greater detail) of a portable power tool (not illustrated here in greater detail). The portable power tool and the coupling device in this case have a structure similar to the exemplary embodiment that has been described in FIGS. 1 to 5. The cutter support elements 14*b*, 16*b* are each interconnected by means of a connecting element 18*b*, 20*b*, 96*b* of the cutting assembly 12*b* (FIG. 7). In this case, the connecting elements 18*b*, 20*b*, 96*b* terminate at least substantially flush with outer faces 22*b*, 24*b* of the cutter support elements 14*b*, 16*b* in an assembled state (FIGS. 7 and 8). The connecting elements 18*b*, 20*b*, 96*b* are formed as pins 26*b*, 28*b*, 98*b*. Furthermore, the connecting elements 18*b*, 20*b* 96*b* are formed separately from the cutter support elements 14*b*, 16*b*.

When the cutting assembly 12*b* is assembled, the cutter support elements 14*b*, 16*b* are interconnected by means of the connecting elements 18*b*, 20*b*, 96*b*. In this case, the connecting elements 18*b*, 20*b* 96*b* are introduced in connecting recesses 64*b*, 66*b*, 94*b*, 112*b* in the cutter support elements 14*b*, 16*b* until the connecting elements 18*b*, 20*b* terminate at least substantially flush with the outer faces 22*b*, 24*b* of the cutter support elements 14*b*, 16*b*. The connecting elements 18*b*, 20*b*, 96*b* are guided by means of the guide unit 30*b* in an assembled state of the cutting assembly 12*b* in a guide unit 30*b* of the power tool separation device 10*b* (FIG. 8). In this case, the connecting elements 18*b*, 20*b*, 96*b* are arranged in a guide groove 60*b* of the guide unit 30*b* in an assembled state of the cutting assembly 12*b*. The connecting elements 18*b*, 20*b*, 96*b* can be supported, considered in a plane running perpendicular to a cutting plane, on two side walls 68*b*, 70*b* of the guide groove 60*b*. The side walls 68*b*, 70*b* of the guide groove 60*b* extend, considered in the cutting plane, outwardly starting from the guide unit 30*b*, perpendicular to a cutting direction 52*b* of the cutting assembly 12*b*. Furthermore, the side walls 68*b*, 70*b* are formed in one piece with outer walls 72*b*, 74*b* of the guide unit 30*b*.

Furthermore, the connecting elements 18*b*, 20*b*, 96*b* have a porous structure. In this case, the connecting elements 18*b*, 20*b*, 96*b* each have a multiplicity of cavities 90*b*, 92*b*, 104*b*, 106*b*, 108*b*, 110*b*, which are arranged within total volumes of the connecting elements 18*b*, 20*b*, 96*b*. The cavities 90*b*, 92*b*, 104*b*, 106*b*, 108*b*, 110*b* are formed as pores. The cavities 90*b*, 92*b*, 104*b*, 106*b*, 108*b*, 110*b* can be distributed in this case uniformly and/or non-uniformly in the total volumes of the connecting elements 18*b*, 20*b*, 96*b*. The connecting elements 18*b*, 20*b*, 96*b* are each saturated with a lubricant (not illustrated here in greater detail), which is provided to lubricate a lubrication of the connecting elements 18*b*, 20*b*, 96*b* arranged movably in the connecting recesses 64*b*, 66*b*, 94*b*, 112*b* and in the guide groove 60*b*. The lubricant is in this case arranged in the cavities 90*b*, 92*b*, 104*b*, 106*b*, 108*b*, 110*b*, formed as pores, in the connecting elements 18*b*, 20*b*, 96*b*.

Figure 9:
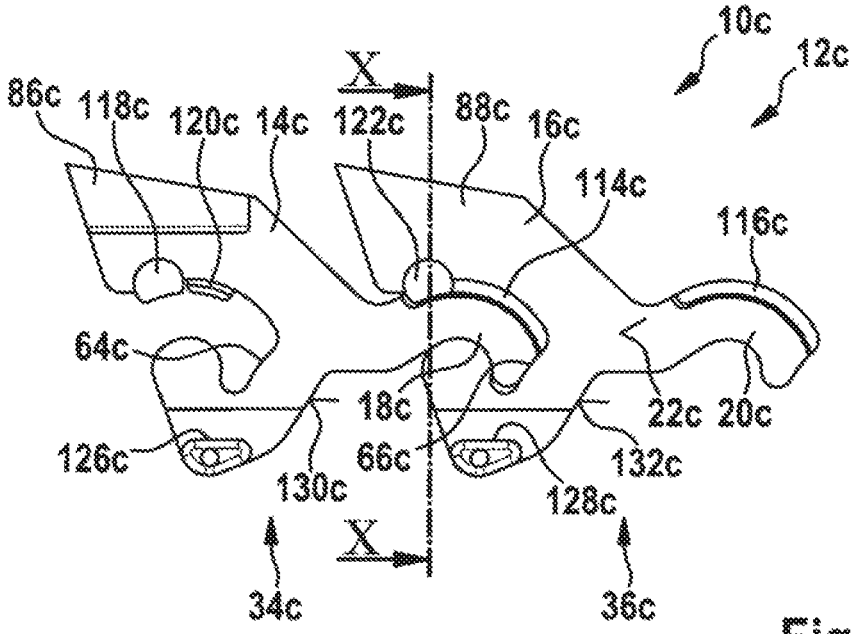
FIG. 9 shows a schematic illustration of a detail of cutter support elements of a cutting assembling of a further, alternative power tool separation device according to the disclosure.
Figure 10:
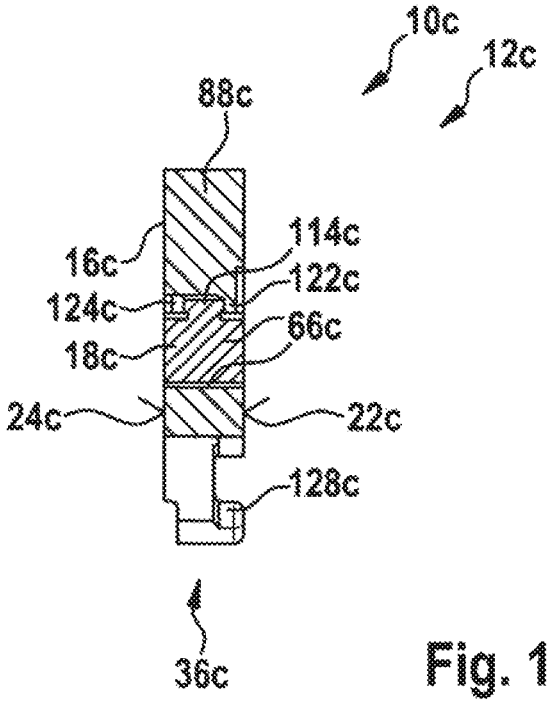
FIG. 10 shows a schematic illustration of a sectional view of the cutter support elements along the line X-X from FIG. 9.
Figure 11:
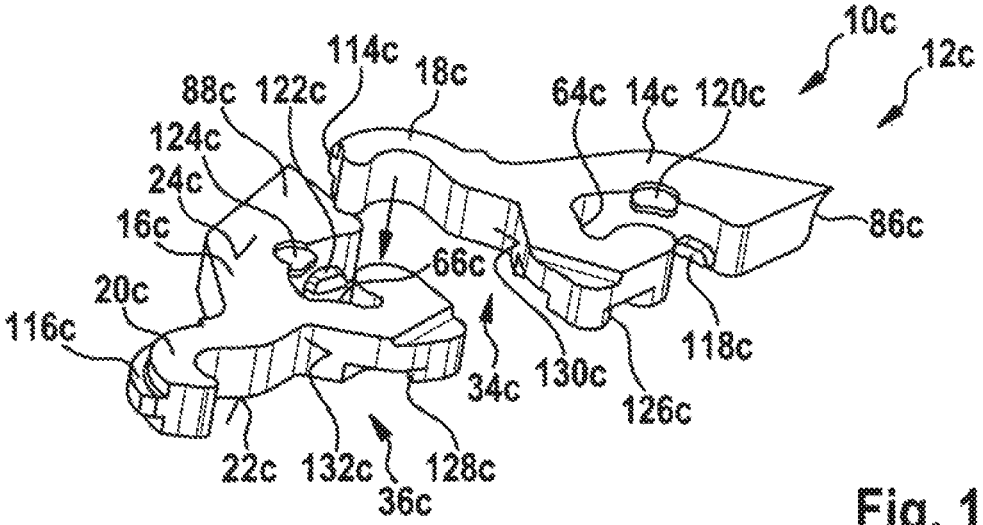
FIG. 11 shows a schematic illustration of a detail of an assembly position of the cutter support elements from FIG. 9.

FIG. 9 shows two cutter support elements 14*c*, 16*c*, coupled to one another, of a cutting assembly 12*c* of a further, alternative power tool separation device 10*c*. The cutter support elements 14*c*, 16*c* are interconnected by means of at least one connecting element 18*c* of the cutting assembly 12*c*, which terminates at least substantially flush with at least one outer face 22*c*, 24*c* of one of the at least two cutter support elements 14*c*, 16*c* (FIG. 10). In this case, the connecting element 18*c*, considered along a transverse axis of the connecting element 18*c*, terminates flush with both outer faces 22*c*, 24*c* of one of the at least two cutter support elements 14*c*, 16*c*. The transverse axis of the connecting element 18*c* runs, in a state in which the cutter support elements 14*c*, 16*c* are coupled to one another, at least substantially perpendicular to a cutting plane of the cutting assembly 12*c*. The connecting element 18*c* is formed in one piece with one of the two cutter support elements 14*c*, 16*c*. In this case, the connecting element 18*c* is formed as a longitudinal extension of one of the at least two cutter support elements 14*c*, 16*c*. The connecting element 18*c* formed as a longitudinal extension extends at least substantially along a longitudinal extension of the cutter support element 14*c*, with which the connecting element 18*c* is formed in one piece. In this case, the longitudinal extension is formed in a hook-shaped manner. Each cutter support element 14*c*, 16*c* of the cutting assembly 12*c* of the power tool separation device 10*c* has a connecting element 18*c*, 20*c* formed as a longitudinal extension and a connecting recess 64*c*, 66*c* formed in a manner corresponding to the connecting element 18*c*. In order to form the cutting assembly 12*c* formed as a cutting chain, the individual connecting elements 18*c*, 20*c* of the cutter support elements 14*c*, 16*c* are each provided so as to produce, by means of a corporation with a connecting recess 64*c*, 66*c*, a form-locked connection between the cutter support elements 14*c*, 16*c*, by means of which the cutter support elements 14*c*, 16*c* are pivotably interconnected.

Furthermore, the connecting element 18*c* formed as a longitudinal extension has a transverse securing region 114*c* on one side. The transverse securing region 114*c* is provided so as to at least largely prevent, by means of a cooperation with at least one transverse securing element 118*c*, 120*c*, a transverse movement of the cutter support elements 14*c*, 16*c* relative to one another along at least two oppositely directed directions in a coupled state. In this case, the transverse securing region 114*c* is formed as a rib. It is also conceivable however for the transverse securing region 114*c* to have another embodiment appearing sensible to a person skilled in the art, such as an embodiment as a groove, etc. The transverse securing region 114*c* is arranged on a side of the connecting element 18*c* facing towards a cutting element 86*c* formed in one piece with the cutter support element 14*c*. In this case, the transverse securing region 114*c*, considered in the cutting plane of the cutting assembly 12*c*, extends on the connecting element 18*c* in a circular-segment-shaped manner.

For transverse securing of the cutter support elements 14*c*, 16*c* by means of a cooperation of the transverse securing regions 114*c*, 116*c* with the transverse securing elements 118*c*, 120*c*, at least one of the at least two cutter support elements 14*c*, 16*c* has at least one transverse securing element 118*c*, 120*c*, which is provided to at least largely prevent a transverse movement of the cutter support elements 14*c*, 16*c* relative to one another in a coupled state. On the whole, each of the cutter support elements 14*c*, 16*c* has at least two transverse securing elements 118*c*, 120*c*, 122*c*, 124*c*. The transverse securing elements 118*c*, 120*c*, 122*c*, 124*c* are each arranged in an edge region of the respective cutter support element 14*c*, 16*c* delimiting the connecting recesses 64*c*, 66*c*. In this case, the transverse securing elements 118*c*, 120*c*, 122*c*, 124*c* are formed in one piece with the cutter support element 14*c*, 16*c*. The transverse securing elements 118*c*, 120*c*, 122*c*, 124*c* are each formed integrally on the respective cutter support element 14*c*, 16*c* by means of a stamping method. The transverse securing elements 118*c*, 120*c*, 122*c*, 124*c*, considered along a direction running at least substantially perpendicular to the cutting plane of the cutting assembly 12*c*, thus extend at most as far as the outer faces 22*c*, 24*c* of the cutter support elements 14*c*, 16*c*. It is also conceivable however for the transverse securing elements 118*c*, 120*c*, 122*c*, 124*c* to be formed in one piece on the respective cutter support element 14*c*, 16*c* by means of another method appearing sensible to a person skilled in the art, for example by means of a welding method, by means of an adhesive bonding method, by means of a punching method, by means of a bending method, etc.

In addition, the two transverse securing elements 118*c*, 120*c*, 122*c*, 124*c* arranged on each of the cutter support elements 14*c*, 16*c*, considered along a direction running at least substantially perpendicular to the cutting plane of the cutting assembly 12*c*, are arranged on sides of the cutter support elements 14*c*, 16*c* remote from one another. Furthermore, the two transverse securing elements 118*c*, 120*c*, 122*c*, 124*c* arranged on each of the cutter support elements 14*c*, 16*c* are arranged on the respective cutter support element 14*c*, 16*c* in a manner offset relative to one another. The transverse securing elements 118*c*, 120*c*, 122*c*, 124*c*, based on the cutting plane of the cutting assembly 12*c*, are thus arranged on the cutter support elements 14*c*, 16*c* in a manner differing from an axially symmetrical arrangement. In this case, the transverse securing elements 118*c*, 120*c*, 122*c*, 124*c* are formed as partial extensions on an edge region of the connecting recesses 64*c*, 66*c*. It is also conceivable however for the transverse securing elements 118*c*, 120*c*, 122*c*, 124*c* to have another embodiment and/or arrangement appearing sensible to a person skilled in the art, such as an embodiment in the form of webs running parallel, which delimit a groove-shaped recess in the edge region of the respective connecting recess 64*c*, 66*c*, considered along a direction running at least substantially perpendicular to the cutting plane of the cutting assembly 12*c*.

Furthermore, at least one of the at least two cutter support elements 14*c*, 16*c* has at least one segment guide element 126*c*, which is provided so as to delimit a movement of the at least one of the at least two cutter support elements 14*c*, 16*c* in a state arranged in a guide unit (not illustrated here in greater detail) of the power tool separation device 10*c*, considered in a direction remote from the guide unit, at least along a direction running at least substantially parallel to the cutting plane of the cutting assembly 12*c*. The segment guide element 126*c* is formed by a transverse extension, which delimits a longitudinal groove. The segment guide element 126*c* formed as a transverse extension extends in this case at least substantially perpendicular to the cutting plane of the cutting assembly 12*c*. In this case the segment guide element 126*c* is provided so as to cooperate, in order to delimit a movement, with a segment counter guide element (not illustrated here in greater detail) arranged on the guide unit, said segment counter guide element being formed in a manner corresponding to the segment guide element 126*c*. It is also conceivable however for the segment guide element 126*c* to have a different embodiment appearing sensible to a person skilled in the art, such as an embodiment as a rib, etc., which cooperates with a groove arranged on the guide unit to delimit a movement. Each cutter support element 14*c*, 16*c* of the cutting assembly 12*c* comprises a segment guide element 126*c*, 128*c*, which is provided to define a movement of the at least one of the at least two cutter support elements 14*c*, 16*c*, in a state arranged in a guide unit of the power tool separation device 10*c*, considered in a direction remote from the guide unit, at least along a direction running at least substantially parallel to the cutting plane of the cutting assembly 12*c*.

The cutter support elements 14*c*, 16*c* of the cutting assembly 12*c* further each have a drive face 130*c*, 132*c*, which is provided, in order to drive the cutting assembly 12*c*, to cooperate with the drive faces of a torque transmission element (not illustrated here in greater detail). The drive faces of the torque transmission element are formed in this case as tooth flanks. The drive faces 130*c*, 132*c* of the cutter support elements 14*c*, 16*c* are thus formed in a manner corresponding to the drive faces of the torque transmission element. When the cutting assembly 12*c* is driven, the tooth flanks of the torque transmission element bear temporarily against the drive faces 130*c*, 132*c* for a transmission of driving forces.

In order to assemble the cutting assembly 12*c*, the cutter support elements 14*c*, 16*c* are moved towards one another along a direction running at least substantially perpendicular to the cutting plane of the cutting assembly 12*c* (FIG. 11), wherein the connecting elements 18*c*, 20*c* are each inserted via an insertion region into the connecting recesses 64*c*, 66*c* until the outer faces 22*c*, 24*c* of the cutter support elements 14*c*, 16*c* are each arranged in a common plane running at least substantially parallel to the outer faces 22*c*, 24*c*. The cutter support elements 14*c*, 16*c* are then pivoted relative to one another about a pivot axis running substantially perpendicular to the cutting plane of the cutting assembly 12*c* until the transverse securing regions 114*c*, 116*c* are each slid between the transverse securing elements 118*c*, 120*c*, 122*c*, 124*c* or until the insertion regions of the connecting elements 18*c*, 20*c* contact the connecting recesses 64*c*, 66*c* along edge regions delimiting the longitudinal extension of the cutter support elements 14*c*, 16*c*. The cutter support elements 14*c*, 16*c* are thus mounted so as to be pivotable relative to one another by means of a cooperation of the connecting elements 18*c*, 20*c* and the connecting recesses 64*c*, 66*c*.

Figure 12:
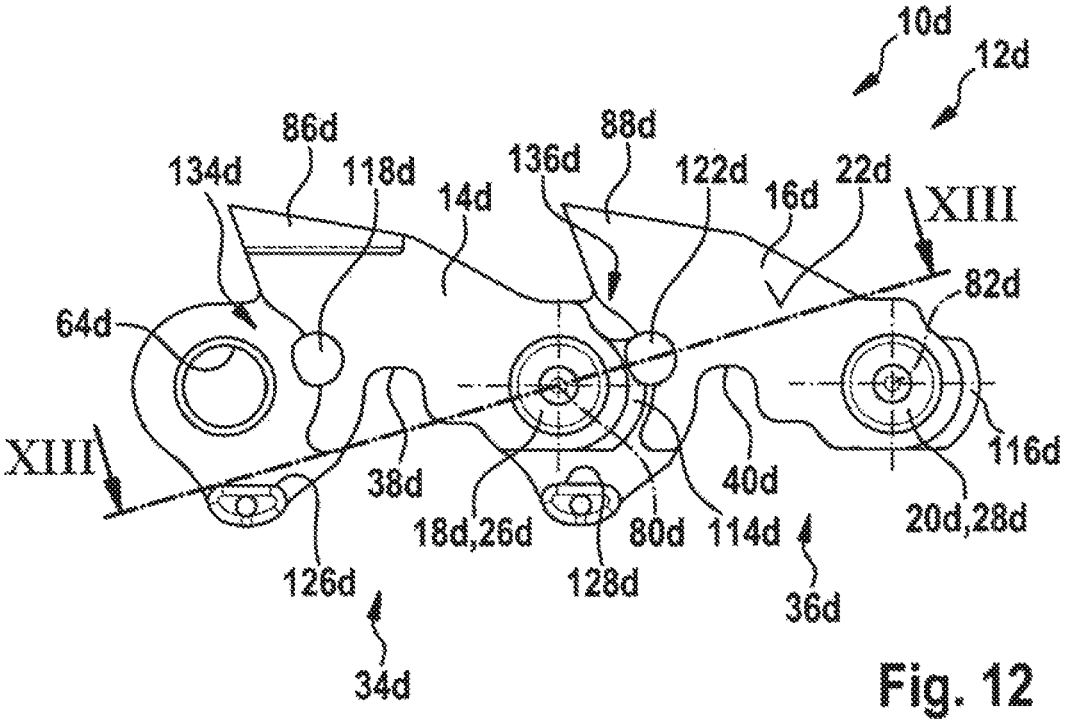
FIG. 12 shows a schematic illustration of a detail of cutter support elements of a cutting assembly of a further, alternative power tool separation device according to the disclosure.
Figure 13:
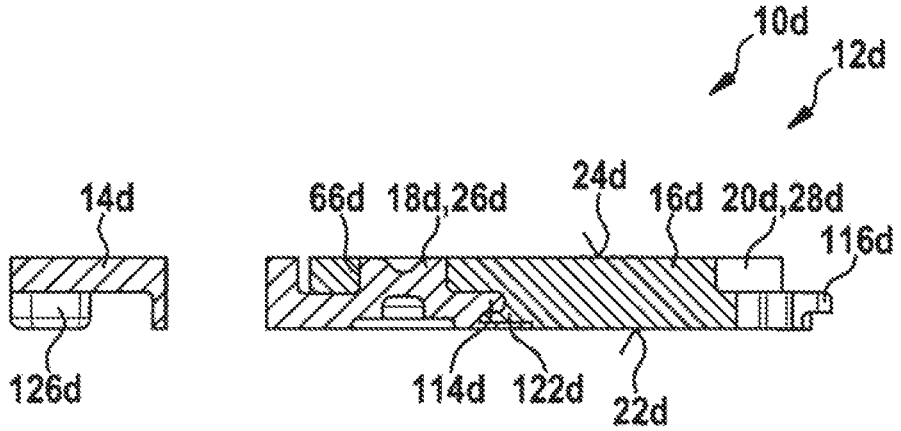
FIG. 13 shows a schematic illustration of a sectional view of the cutter support elements along the line XIII-XIII from FIG. 12.
Figure 14:
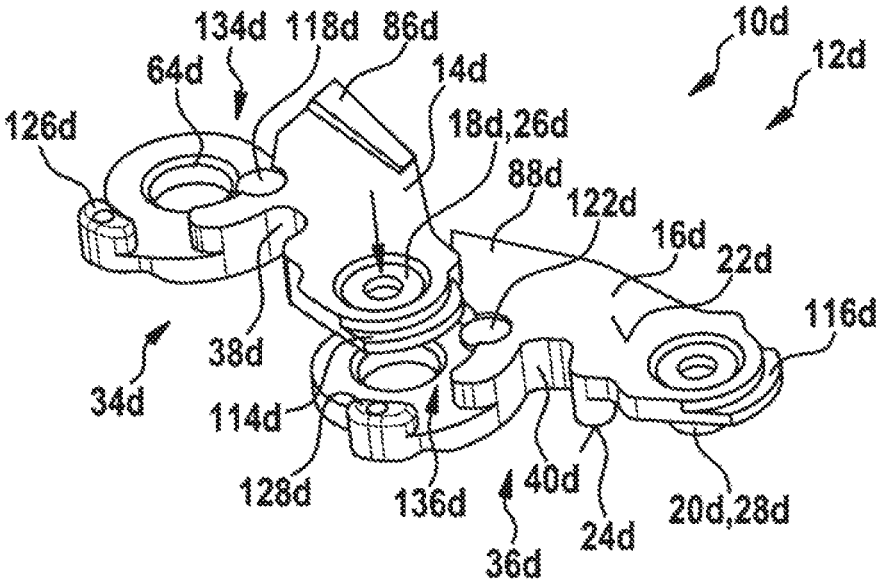
FIG. 14 shows a schematic illustration of a detail of an assembly position of the cutter support elements from FIG. 12.

FIG. 12 shows two cutter support elements 14*d*, 16*d*, coupled to one another, of a cutting assembly 12*d* of a further, alternative power tool separation device 10*d*. The cutter support elements 14*d*, 16*d* are interconnected by means of at least one connecting element 18*d* of the cutting assembly 12*d*, which terminates at least substantially flush with at least one outer face 22*d*, 24*d* of one of the at least two cutter support elements 14*d*, 16*d* (FIG. 13). In this case, the connecting element 18*d*, considered along a longitudinal axis of the connecting element 18*d*, terminates flush with an outer face 22*d* of one of the at least two cutter support elements 14*d*, 16*d*. The longitudinal axis of the connecting element 18*d* extends at least substantially perpendicular to a cutting plane of the cutting assembly 12*d*. Furthermore, the connecting element 18*d* is formed in one piece with at least one of the at least two cutter support elements 14*d*, 16*d*. The connecting element 18*d* is formed in this case as a pin 26*d*. The pin 26*d* extends along a direction running at least substantially perpendicular to a cutting plane of the cutting assembly 12*d*. Each cutter support element 14*d*, 16*d* of the cutting assembly 12*d* of the power tool separation device 10*d* has at least one connecting element 18*d*, 20*d* formed as pins 26*d*, 28*d* and a connecting recess 64*d*, 66*d* formed in a manner corresponding to the connecting element 18*d*, 20*d*. To form the cutting assembly 12*d* formed as a cutting chain, the individual connecting elements 18*d*, 20*d* of the cutter support elements 14*d*, 16*d* are each provided so as to produce, by means of a cooperation with a connecting recess 64*d*, 66*d*, a form-locked connection between the cutter support elements 14*d*, 16*d*, by means of which the cutter support elements 14*d*, 16*d* are interconnected pivotably.

Furthermore, the cutter support elements 14*d*, 16*d* each have at least one transverse securing element 118*d*, 122*d*, which is provided to at least largely prevent a transverse movement of the cutter support elements 14*d*, 16*d* relative to one another in a coupled state. In addition, the cutter support elements 14*d*, 16*d* have a transverse securing region 114*d*, 116*d*. The transverse securing regions 114*d*, 116*d* are each formed in a manner corresponding to the transverse securing elements 118*d*, 122*d* in order to at least largely prevent, by means of a cooperation with the transverse securing elements 118*d*, 122*d*, a transverse movement of the cutter support elements 14*d*, 16*d* in a coupled state. The transverse securing elements 118*d*, 122*d* are formed as extensions. In this case, the transverse securing elements 118*d*, 122*d* are each arranged in a coupling region 134*d*, 136*d* of the cutter support elements 14*d*, 16*d*. The transverse securing elements 118*d*, 122*d* together with the respective coupling region 124*d*, 136*d* thus delimit a groove-shaped recess running at least substantially parallel to the cutting plane of the cutting assembly 12*d* and intended to receive the respective transverse securing region 114*d*, 116*d* in a coupled state of the cutter support elements 14*d*, 16*d*. The connecting recesses 64*d*, 66*d*, into which the connecting elements 18*d*, 20*d* are introduced so as to produce a form-locked connection during assembly of the cutting assembly 12*d*, are arranged in the coupling regions 134*d*, 136*d*. The transverse securing elements 118*d*, 122*d* are formed in one piece with the cutter support elements 14*d*, 16*d*. In this case, the transverse securing elements 118*d*, 122*d* are each formed in one piece on the respective cutter support element 14*d*, 16*d* by means of a stamping method. The transverse securing elements 118*d*, 122*d*, considered along a direction running at least substantially perpendicular to the cutting plane of the cutting assembly 12*b*, thus extend at most as far as the outer faces 22*d*, 24*d* of the cutter support elements 14*d*, 16*d*. It is also conceivable however for the transverse securing elements 118*d*, 122*d* to be formed integrally on the respective cutter support element 14*d*, 16*d* by means of another method appearing sensible to a person skilled in the art, for example by means of a welding method, by means of an adhesive bonding method, by means of a punching method, by means of a bending method, etc.

The transverse securing regions 114*d*, 116*d*, considered along a cutting direction 52*d*, are each arranged on one side of the respective cutter support element 14*d*, 16*d* remote from the coupling region 134*d*, 136*d*. In this case, the transverse securing regions 114*d*, 116*d* are each formed as a rib-shaped longitudinal extension. It is also conceivable however for the transverse securing regions 114*d*, 116*d* to have another embodiment appearing sensible to a person skilled in the art, for example an embodiment as a groove, etc. The transverse securing elements 18*d*, 122*d* overlap the transverse securing regions 114*d*, 116*d* in a coupled state of the cutter support elements 14*d*, 16*d* so as to at least largely avoid a transverse movement of the cutter support elements 14*d*, 16*d*.

Furthermore, the cutter support elements 14*d*, 16*d* each have a segment guide element 126*d*, 128*d*, which is provided to delimit a movement of the cutter support elements 14*d*, 16*d*, in a state arranged in a guide unit (not illustrated here in greater detail) of the power tool separation device 10*d*, considered in a direction remote from the guide unit, at least along a direction running at least substantially parallel to the cutting plane of the cutting assembly 12*d*. The segment guide elements 126*d*, 128*d* are formed by a longitudinal groove. In this case, the segment guide elements 126*d*, 128*d* are provided, in order to delimit a movement, to cooperate with a segment counter guide element (not illustrated here in greater detail) arranged on the guide unit, said segment counter guide element being formed in a manner corresponding to the segment guide elements 126*d*, 128*d*.

In an alternative embodiment (not illustrated here) of cutter support elements, transverse securing regions are stamped directly onto the pin-shaped connecting element by means of a stamping method after a connection of the cutter support elements by means of a pin-shaped connecting element, which is formed in one piece with one of the cutter support elements. In addition, in the alternative embodiment (not illustrated here) of the cutter support elements, transverse securing elements are formed by an edge region of a respective connecting recess comprised by the cutter support elements.

In order to assemble the cutting assembly 12*d*, the cutter support elements 14*d*, 16*d* are moved towards one another along a direction running at least substantially perpendicular to the cutting plane of the cutting assembly 12*d* (FIG. 14), wherein the connecting elements 18*d*, 20*d* are each introduced into the connecting recesses 64*d*, 66*d* along the direction running at least substantially perpendicular to the cutting plane of the cutting assembly 12*d* until outer faces 22*d*, 24*d* of the cutter support elements 14*d*, 16*d* bear against the corresponding coupling regions 134*d*, 136*d*. The cutter support elements 14*d*, 16*d* are then pivoted relative to one another about a pivot axis running substantially perpendicular to the cutting plane of the cutting assembly 12*d* until the transverse securing regions 114*d*, 116*d* are each slid into the groove-shaped recesses formed by the transverse securing elements 118*d*, 122*d* and the coupling regions 134*d*, 136*d*. The cutter support elements 14*d*, 16*d* are thus mounted so as to be pivotable relative to one another by means of a cooperation of the connecting elements 18*d*, 20*d* and the connecting recesses 64*d*, 66*d*.

The invention claimed is:

1. A power tool separation device comprising:

at least one cutting assembly having at least two cutter support elements, adjacent ones of the at least two cutter support elements directly connected to each other, each cutter support element including a cutting element integral therewith, the cutting elements of the at least two cutter support elements defining a cutting plane, and at least one guide unit configured to receive the cutting assembly, wherein adjacent cutter support elements of the at least two cutter support elements are directly connected by at least one connecting element, said connecting element formed as a pin extending between said adjacent cutter support elements transverse to the cutting plane and received within an opening defined in each of said adjacent cutter support elements, the pin terminating at least substantially flush with at least one outer face of the other of the adjacent cutter support elements, wherein the entire connecting element is a porous structure, and wherein the connecting element is in contact with and guided by said guide unit.

2. The power tool separation device as claimed in claim 1, wherein at least one of the at least two cutter support elements has at least one transverse securing element configured to at least largely prevent a transverse movement of the at least two cutter support elements relative to one another in a coupled state of the at least two cutter support elements.

3. The power tool separation device as claimed in claim 2, wherein the at least one transverse securing element is formed integrally on the at least one of the at least two cutter support elements by a stamping method.

4. The power tool separation device as claimed in claim 1, wherein at least one of the at least two cutter support elements has at least one segment guide element configured to delimit a movement of the at least one of the at least two cutter support elements, in a state arranged in a guide unit, considered in a direction remote from the guide unit, at least along a direction running at least substantially parallel to a cutting plane of the cutting assembly.

5. The power tool separation device as claimed in claim 1, further comprising:

at least one guide unit configured to receive the cutting assembly, wherein the connecting element is guided at least in part in said guide unit.

6. The power tool separation device as claimed in claim 5, wherein the at least one guide unit includes at least one torque transmission element mounted at least in part in the at least one guide unit.

7. The power tool separation device as claimed in claim 6, wherein:

at least one of the at least two cutter support elements, on a side of the cutter support element facing towards the torque transmission element, has at least one recess, and in at least one operating state, the torque transmission element engages the at least one recess to drive the cutting assembly.

8. The power tool separation device at least as claimed in claim 6, wherein at least one of the at least two cutter support elements is formed at least substantially in a circular-arc-shaped manner on a side of the cutter support element facing towards the torque transmission element.

9. A portable power tool comprising:

a coupling device; and a power tool separation device having at least one cutting assembly having at least two interconnected cutter support elements, each cutter support element including a cutting element integral therewith, the cutting elements of the at least two cutter support elements defining a cutting plane, and at least one guide unit configured to receive the cutting assembly, wherein adjacent cutter support elements of the at least two cutter support elements are directly connected by at least one connecting element, said connecting element formed as a pin extending between said adjacent cutter support elements transverse to the cutting plane and received within an opening defined in each of said adjacent cutter support elements, the pin terminating at least substantially flush with at least one outer face of the other of the adjacent cutter support elements, wherein the connecting element is in contact with and guided by said guide unit, wherein the entire connecting element is a porous structure, and wherein the coupling device is coupled to the at least one guide unit by at least one of a form-locked coupling and a forced-locked coupling.

10. A power tool system comprising:

a portable power tool having a coupling device; and a power tool separation device having at least one cutting assembly having at least two interconnected cutter support elements, each cutter support element including a cutting element integral therewith, the cutting elements of the at least two cutter support elements defining a cutting plane, and at least one guide unit configured to receive the cutting assembly, wherein adjacent cutter support elements of the at least two cutter support elements are directly connected by at least one connecting element, said connecting element formed as a pin extending between said adjacent cutter support elements transverse to the cutting plane and received within an opening defined in each of said adjacent cutter support elements, the pin terminating at least substantially flush with at least one outer face of the other of the adjacent cutter support elements, wherein the connecting element is in contact with and guided by said guide unit, wherein the entire connecting element is a porous structure, and wherein the coupling device is coupled to the at least one guide unit by at least one of a form-locked coupling and a forced-locked coupling.

* * * * *